US005224242A

United States Patent [19]

Marjanovic

[11] Patent Number: 5,224,242

[45] Date of Patent: Jul. 6, 1993

[54] QUICK-ASSEMBLING FURNITURE HINGE

[75] Inventor: Mihajlo Marjanovic, Koper, Yugoslavia

[73] Assignee: Mednarodno podjetje Lama, d.d., Dekani, Slovenia

[21] Appl. No.: 730,998

[22] Filed: Jul. 16, 1991

[51] Int. Cl.[5] ..... E05D 7/10; E05D 7/12

[52] U.S. Cl. ..... 16/258; 16/DIG. 43

[58] Field of Search ..... 16/254, 257, 258, 259, 16/DIG. 43

[56] References Cited

U.S. PATENT DOCUMENTS

| | | | |
|---|---|---|---|
| 4,423,537 | 1/1984 | Salice | 16/258 |
| 4,799,290 | 1/1989 | Lautenschlager | 16/258 |
| 4,800,621 | 1/1989 | Rock et al. | 16/254 |
| 4,839,940 | 6/1989 | Grass | 16/248 |
| 4,999,877 | 3/1991 | Gasser | 16/258 |
| 5,025,530 | 6/1991 | Ferrari et al. | 16/258 |
| 5,054,164 | 10/1991 | Blanco-Equiluz | 16/258 |

FOREIGN PATENT DOCUMENTS

| | | | |
|---|---|---|---|
| 0145952 | 6/1985 | European Pat. Off. | 16/273 |
| 0255692 | 2/1988 | European Pat. Off. | 16/258 |
| 256376 | 2/1988 | European Pat. Off. | 16/258 |
| 2806958 | 8/1978 | Fed. Rep. of Germany | 16/242 |
| 3119571 | 12/1982 | Fed. Rep. of Germany . | |
| 3639276 | 5/1988 | Fed. Rep. of Germany . | |
| 3939080 | 5/1990 | Fed. Rep. of Germany | 16/254 |
| 2232716 | 12/1990 | United Kingdom | 16/258 |
| 9110031 | 7/1991 | World Int. Prop. O. | 16/258 |

*Primary Examiner*—Lowell A. Larson
*Assistant Examiner*—Donald M. Gurley
*Attorney, Agent, or Firm*—Keck, Mahin & Cate

[57] ABSTRACT

The invention relates to a quick-assembling furniture hinge of the type which by some elementary movements enables incorporation of a furniture door wing, essentially carrying the entire hinge, to a base plate fixed on a side wall of furniture. In a manner as simple and quick there can also be carried out the dismounting of the door wing. In order to realize this object a hinge arm 1 positioned on the furniture side wall is provided with a disintegratingly and adjustably fastened mounting element 2 serving as an intermediate between the hinge arm 1 and the base plate 4. To the equipment of the mounting element 2 there belongs a slider 3 which is spring-supported and pressed outwards from the mounting element 2. The latter is at both ends at the base provided with one crossbeam $2^{I}$, $2^{II}$. The first one thereof is adapted to grip a lashing $4^{II}$ of the base plate 4 from below and the other one serving for guiding the slider 3 and retaining thereof in terminal position in the direction of drawing-out the slider 3 from the mounting element 2. The slider 3 comprises a pusher stud $3^{II}$ and a latch $3^{I}$, whose free ends cooperates with a stationary crossbeam $4^{I}$ of the base plate 4.

3 Claims, 4 Drawing Sheets

QUICK-ASSEMBLING FURNITURE HINGE

TECHNICAL FIELD

The invention belongs to the field of fittings in construction engineering, it relating thereunder to hinge fittings for furniture wings. and among these particularly to hinges which are adapted for quick incorporation or dismounting of a wing, the hinges conceived on the use of two or more hinge dowels.

The articles as set above are classified into Class E 05D 7/08 of International Patent Classification.

TECHNICAL PROBLEM

The invention is based on a problem how to interconnect a hinge arm and a stationary base plate fixed on a furniture side wall in order to fulfil the condition that at dismounting the wing in a manner that one hand of operator is reserved for retaining the wing, the other hand would suffice to unlock the interconnection between the hinge arm and the base plate as well as for spatial separation of the hinge arm from the base plate.

PRIOR ART

A furniture hinge wherein requirements of quick incorporation and also of quick dismounting are considered is known from DE 35 25 279. The hinge arm, whose location of incorporation resides on the furniture side wall, is connected to the latter by means of an adapted mounting plate, the latter being permanently fixed on the furniture side wall and serving as a base element for the disconnectable connection with the hinge arm, the base plate in fact serving said arm. For interconnection of the hinge arm and the base plate, the hinge arm is provided with a subsidiary mounting element, i.e. that in fact the interconnection of the subsidiary mounting element of the hinge arm and the stationary base plate is in question. To this purpose the base plate is on the side oriented to the depth of the furniture element provided with a bearing projection and on the side facing the pivot of the hinge provided with a pair of clamp projections arranged perpendicularly to the system surface of the base plate. According to the rules of mating, the mounting element of the hinge arm is adapted to the above-mentioned three coupling positions so that the mounting element has an inserting projection on its front section, on its rear section it having a pair of recesses for insertion of the clamp projections. Due to the circumstance that such an interconnection, which is obviously merely of a form-locking type, would as such not suffice, there is at the antecedent solution additionally foreseen a force-locking connection of mating elements. To this end there is in the medium section of the base plate arranged a slider guided longitudinally shiftably and springily supported in guiding direction, which in fact is a supporter of the above-mentioned bearing projection. This slider is simultaneously an element which enables releasing of the connection.

An essential disadvantage of this seemingly convenient solution appears particularly at detaching the furniture wing. The wing lies in "open" position, one hand is intended to hold it and the other hand serves to release the spring connection between the mounting element and the base plate, i.e. the actuating projection of the slider of the base plate is pushed against the spring force; consequently, no hand is available for lifting the hinge arm from the base plate.

SUMMARY OF THE INVENTION

Between a hinge arm and a base plate, the latter permanently fixed on a furniture side wall, there is for both the interconnection of the hinge arm to the base plate and the disintegration of the former from the latter, respectively, interposed between them a mounting element, which is permanently connected to the hinge arm, the connection being disconnectable and adjustable as to the position, to enable quick assembling thereof with the base plate or separation therefrom, said mounting element being at one end, in the concrete case the one closer to the pivot of the hinge part, provided with a crosspiece gripping from below and cooperating with an adapted projection of the base plate, whereas at the other end, in the concrete case the one oriented away from the pivot of the hinge arm, the mounting element is provided with a slider which is supported by a pressure spring and is permanently pushed in the direction outwards to be removed from the mounting element. Conveniently, the slider is essentially characterized by three component units which preferably constitute a single-piece element: Arranged in the axis of the pressure spring is an actuating pusher stud, which is conveniently needed merely for releasing, i.e., for the disintegration of the hinge assembly; arranged beneath the actuation pusher is a latch which is guided by a further crosspiece of the mounting element (this crosspiece is similar to the above-mentioned crosspiece which grips from below; both crosspieces are arranged at the same level, the second crosspiece placed at the other end of the mounting element); and arranged between the actuating pusher stud and the latch is a longitudinal slot as a bearing for the last-mentioned second crosspiece. The latch of the slider of the mounting element is adapted to cooperate with a stationary crossbeam of the base plate. Hereby, the above-mentioned projection of the base plate as well as the crossbeam thereof are arranged over the level of the system surface of the base plate, in the zones placed under both the projection and the crossbeam the base plate being adequately cut-out for entering both the crosspiece gripping from below (at one end) and the latch (at the other end).

The invention is in the following explained in more detail on the basis of an embodiment represented in the attached drawings. Therein show:

DETAILED DESCRIPTION OF THE INVENTION

Figure 1:
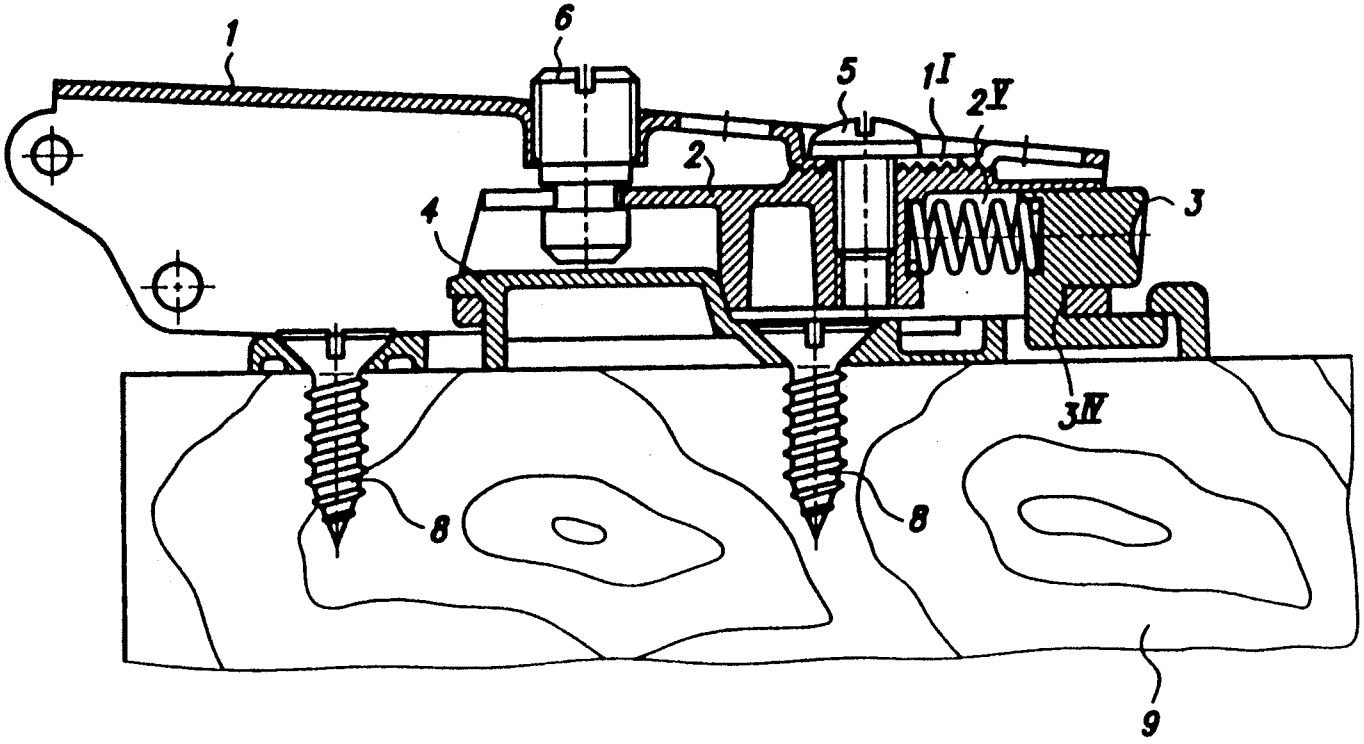
FIG. 1 a longitudinal sectional view of a hinge arm assembly fixed on a furniture wall.
Figure 2:
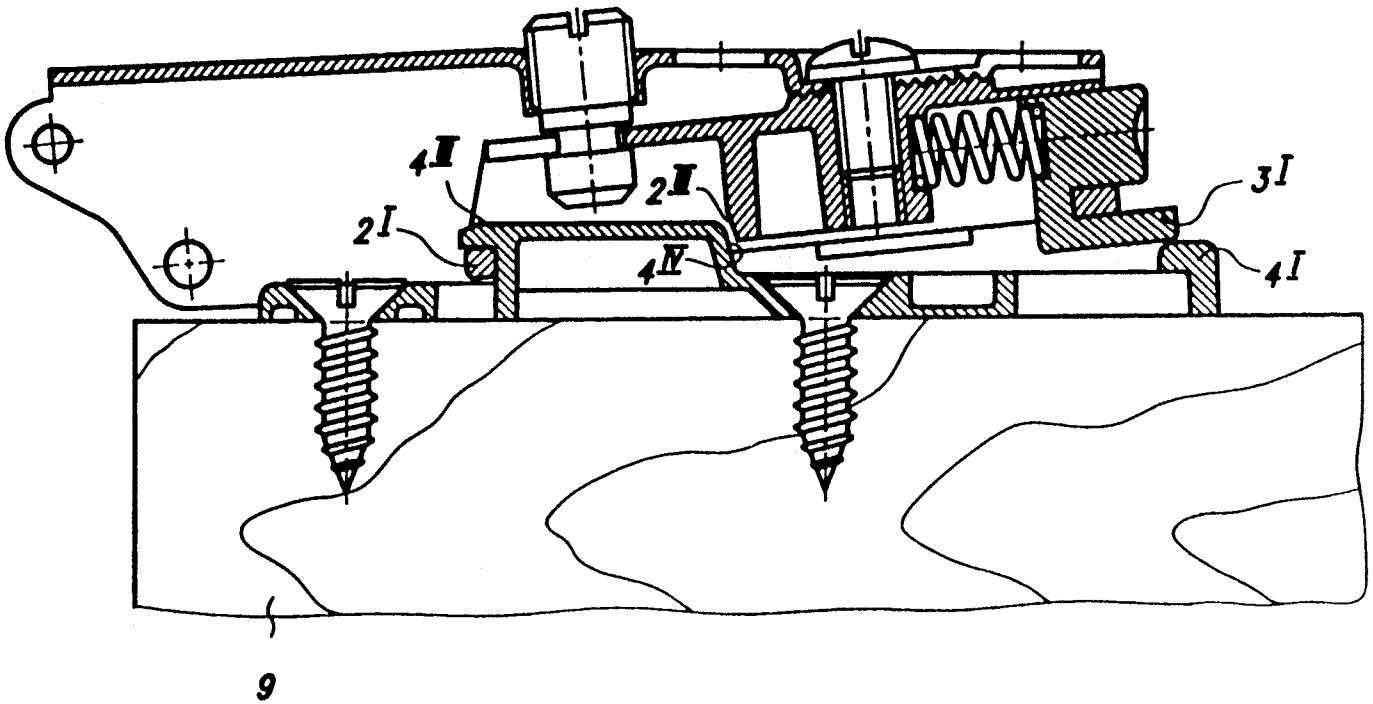
FIG. 2 an assembly of FIG. 1 immediately prior to locking or immediately after unlocking, respectively.
Figure 3:
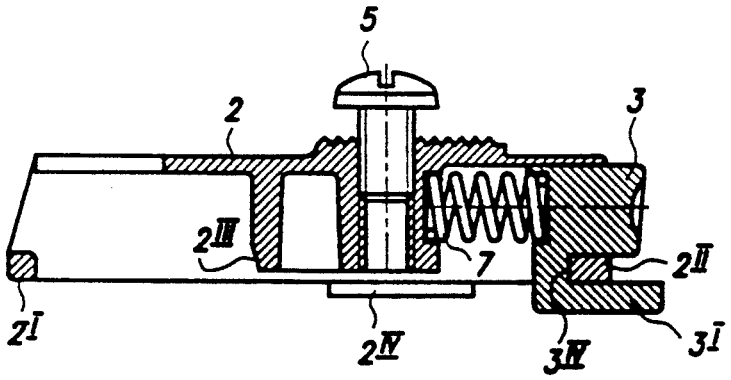
FIG. 3 a detail of FIG. 1 or FIG. 2, respectively, relating to the mounting element of the hinge arm.
Figure 4:
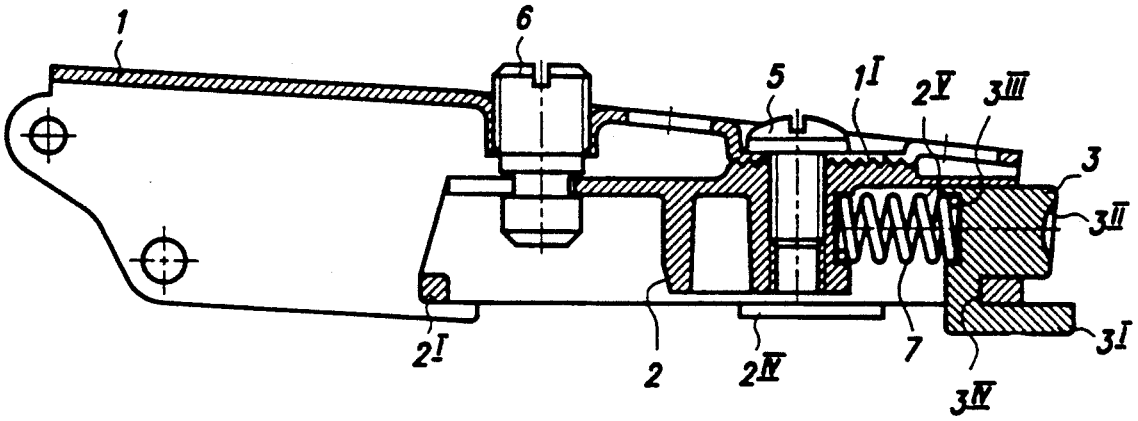
FIG. 4 a detail of FIG. 1 or FIG. 2, respectively, relating to the interrelation of the mounting element of FIG. 3 and the hinge arm.
Figure 5:
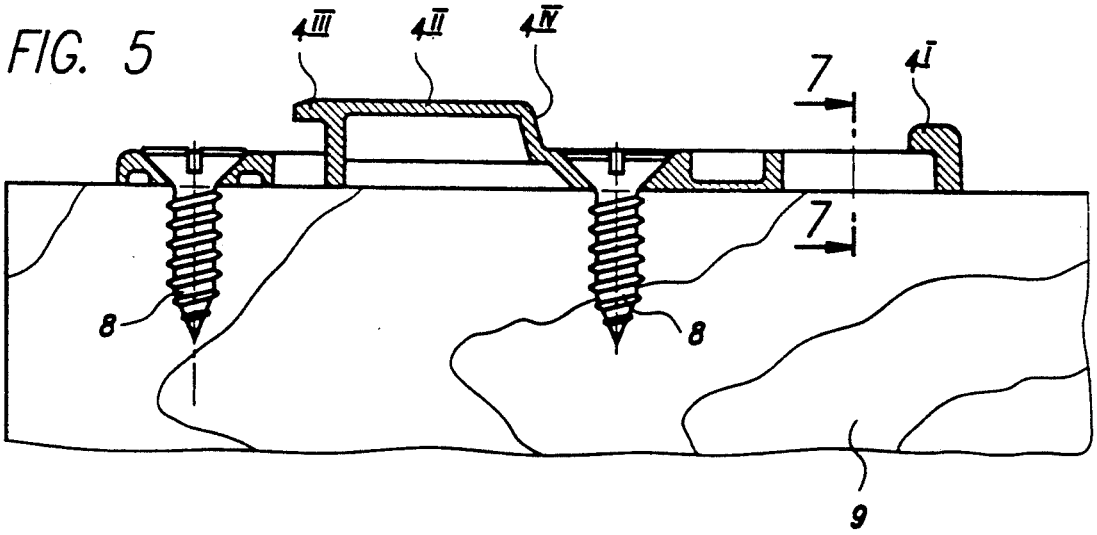
FIG. 5 a detail of FIG. 1 or FIG. 2, respectively, relating to a base plate and to the connection thereof with the furniture side wall.
Figure 6:
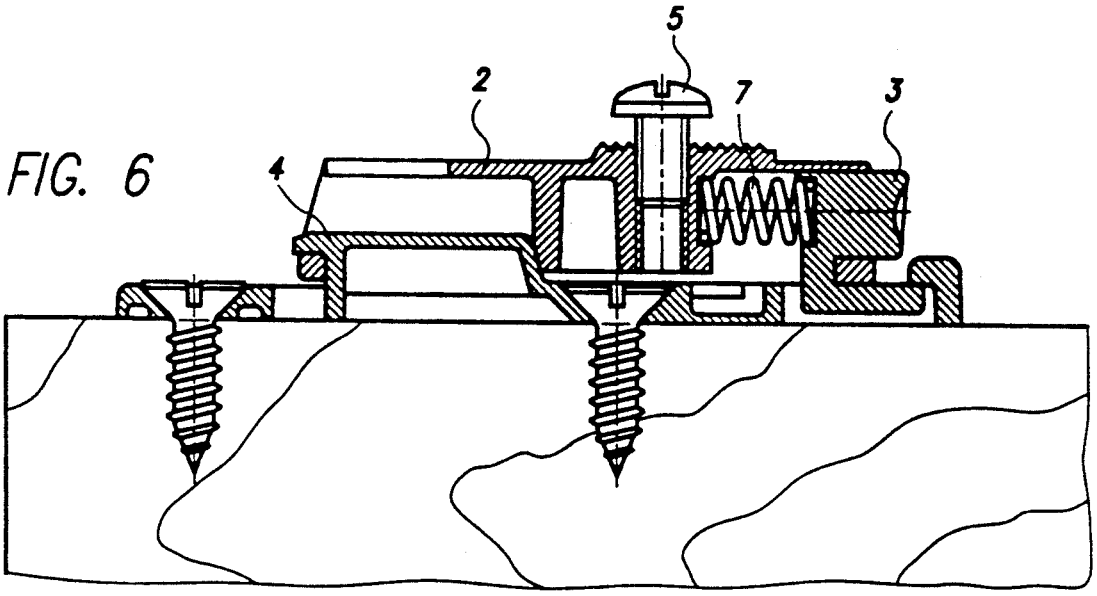
FIG. 6 a detail of FIG. 1 or FIG. 2, respectively, relating to the interrelation of the mounting element of the hinge arm of FIG. 3 and the assembly of the base plate and the furniture side wall of FIG. 5.
Figure 7:
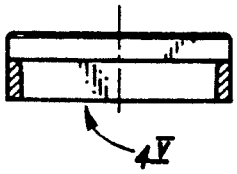
FIG. 7 is a cross-sectional view taken line 7—7 of FIG. 5.

From FIG. 1 the connection of the furniture side wall 9 and the hinge arm 1 is evident. The connection is created indirectly by the base plate 4, which is fixed by two screws 8 to the side wall 9 and with which is connectable or from which is disconnectable the mounting element 2, which is permanently, but disconnectably, joined to the hinge arm 1. The assembly of the hinge arm 1 and the mounting element 2 can at one end be connected to the base plate 4 by a form-locking interconnection and at the other end connected by a force-locking interconnection which is based on spring elasticity.

The hinge arm 1 and the mounting element 2 are mutually connected by a screw 5. The mating surfaces of the hinge arm 1 and the mounting element are uniformly ribbed or indented, the ribs or teeth or one element mating the spaces of teeth of the other one. Conveniently, the tapped hole for the screw 5 is foreseen in the mounting element 2, whereas the hinge arm 1 is provided with an elongated recess $1^{I}$ which enables attaining optimum mutual position of the hinge arm 1 to the mounting element 2 with respect to the state of incorporation. In order to avoid complete unscrewing of the screw 5 at every mounting operation the recess $1^{I}$ is at one end suitably widened with respect to the outline of the head of the screw 5.

To enable adjustment of the slope of the hinge arm 1 to the mounting element 2 the hinge arm 1 is in the area between the screw 5 and its end foreseen for the pivoted connection to the wing part of the hinge provided with a tapped hole into which a screw 6 is inserted which regarding its head is not standardized; it namely ends in the direction towards the mounting element 2 by a club-shaped termination of cylindrical cross-section, the latter being separated from the threaded part of the screw 6 by a circular neck part the length of which corresponds to the thickness of the respective wall of the mounting element 2, whereby the diameter of the neck part corresponds to the nominal width of an elongated open recess in said wall of the mounting element 2 so that between the screw 6 and the mounting element 2 a form-locking connection is formed.

Advantageously, the mounting element 2 is formed as a capsized trough having open end sections and an inside attachment projecting from the roof wall and provided with said tapped hole for the screw 5. The longitudinal side walls of the mounting element 2 are close to their bottom edges at the free end below the elongated open recess serving the screw 6 interconnected by means of a crossbeam $2^{I}$ whose function is disclosed hereinafter. The side longitudinal walls of the mounting element 2 are mutually connected also at the end opposite to the crossbeam $2^{I}$; the connection is realized by an analogous crossbeam $2^{II}$ whose function is disclosed hereinafter.

Into the space $2^{V}$ between the longitudinal walls of the mounting element 2, an attachment for the tapped hole for the screw 5 and said crossbeam $2^{II}$ there is inserted a slider 3 which combines several functions. Between the slider 3 and said tapped-hole attachment is inserted a pressure (spreading) spring 7 for which in the slider 3 is foreseen a scuttled bearing $3^{III}$, an analogous bearing foreseen in the wall of the tapped-hole attachment.

In the axis of the spring 7 the slider 3 is from the outer side formed as a pusher stud $3^{II}$. Separated by a slot $3^{IV}$ from the pusher stud $3^{II}$ is a latch $3^{I}$. The slot $3^{IV}$ is regarding shape and location adapted to the crossbeam $2^{II}$, the length of the latch $3^{I}$ being adapted to the available stroke of the slider 3 and enlarged for the necessary locking length. Advantageously, the pusher stud $3^{II}$ is with respect to the object embodied so that in the pushed-in position the actuation surface thereof is essentially coplanar to the end surface of the assembled hinge arm 1 and the mounting element 2. The freedom of movement of the slider 3 is thus precisely defined.

It is understood that the base plate 4 is adapted to be fixed to the furniture side wall 9 and to receive the mounting element 2 as well as the hinge arm 1 joined to the latter. According to the inventive idea the base plate 4 is systematically divided into two functional sections: A first section arranged in the area beneath the screw 6, and a second section arranged in the area beneath the spring 7. The first section is characterized by the location of a lashing $4^{II}$ over the system plane of the base plate 4, beneath which lashing a recess is foreseen in the plate, the second section being characterized by an arrangement of a crossbeam $4^{I}$ also arranged over the system plane of the plate 4 and beneath which a recess $4^{V}$ is foreseen as well. A hole for inserting a fastening screw 8 is foreseen both in the area preceding the free end $4^{III}$ of the lashing $4^{II}$ and in the middle between the above-mentioned sections. A transition piece $4^{IV}$ interconnecting the lashing $4^{II}$ and the second section of the base plate 4 is embodied with a solid wall.

The side walls of the trough-shaped mounting element 2 are in the area of the screw 5 each provided with a band appendage $2^{IV}$ which at mating the mounting element 2 with the base plate 4 cooperate with a recess $4^{V}$ of the latter. With the aim that the lengths of the band appendages $2^{IV}$ and the recess $4^{V}$ be registered the latter is longitudinally enlarged laterally on both sides of the screw 8 with respect to the longitudinal plane of symmetry of the assembly (not evident from the drawing).

When positioning the assembly of the hinge arm 1 and the mounting element 2 with the corresponding equipment onto the base plate 4, the crossbeam $2^{I}$ is approached to the free end $4^{III}$ of the lashing $4^{II}$ and placed below it. In this position the latch $3^{I}$ strikes the crossbeam $4^{I}$. In the preferred embodiment of the invention the cooperating front edges of the latch $3^{I}$ and the crossbeam $4^{I}$ are conveniently rounded off or bevelled, such characteristic properties of the spring 7 being chosen that the latch $3^{I}$ slides below the crossbeam $4^{I}$ without necessity of the pusher stud $3^{II}$ to be pushed. It is understood that thereby the two band appendages $2^{IV}$ and the corresponding recess $4^{V}$ provide flawless guiding of one element against the other also in the direction transversely to the longitudinal axis.

Dismounting the assembly of the hinge arm 1 and the mounting element 2 as well as the corresponding equipment from the base plate 4, which practically means taking off the door wing from a furniture side wall, represents a reverse operation: One pushes the pusher stud $3^{II}$, i.e. one causes a stroke of the latch $3^{I}$ from below the crossbeam $4^{I}$, simultaneously two fingers of the same hand grip the removable assembly, lift it from the base plate 4 and move it in the direction to the operator, thereby disengaging the crossbeam $2^{I}$ from the lashing $4^{II}$.

It is obvious that all needed movements can be realized with one hand, the other hand being free to hold the door wing. No additional operator is necessary.

I claim:

1. A stationary assembly of a hinge arm on a quick-assembly furniture hinge comprising a mounting element (2) removably and adjustably connected to the hinge arm (1) and arranged between the hinge arm (1) and a base plate (4), said mounting element comprising a first end oriented away from a pivot of the hinge arm (1) and provided with a rectilinearly reciprocating spring-loaded slider (3), said spring-loaded slider being pressed inward in a direction parallel to the length of said hinge arm and toward said pivot of the hinge arm against the bias of a spring (7) for disassembling the hinge arm and mounting element from the base plate, the mounting element (2) being provided with a first crossbeam ($2^{I}$) gripping the base plate from below, and the base plate (4) being provided with a lashing ($4^{II}$) oriented toward the pivot of the hinge arm (1) and arranged above a surface of the base plate (4) and, at the opposite end, the base plate being provided with a second crossbeam ($4^{I}$) arranged over a recess ($4^{V}$) in said base, the first crossbeam ($2^{I}$) being aligned below a free end ($4^{III}$) of the lashing ($4^{II}$) and the second crossbeam ($4^{I}$) engaging a free end of a latch ($3^{I}$) of the slider (3) received in said recess, whereby the latch is disengaged from the second crossbeam when the spring-loaded slider is pressed in said direction.

2. A stationary assembly of claim 1, wherein a pusher stud ($3^{II}$) of the slider (3) is arranged coaxially with the spring (7) and separated from the latch ($3^{I}$) by a slot ($3^{IV}$).

3. A stationary assembly of a hinge arm on a quick-assembly furniture hinge comprising a mounting element (2) removably and adjustably connected to the hinge arm (1) and arranged between the hinge arm (1) and a base plate (4), said mounting element comprising a first end oriented away from a pivot of the hinge arm (1) and provided with a rectilinearly reciprocating spring-loaded slider (3), said spring-loaded slider being pressed inward in a direction parallel to the length of said hinge arm and toward said pivot of the hinge arm against the bias of a spring (7) for disassembling the hinge arm and mounting element from the base plate, the mounting element (2) being provided with a first crossbeam ($2^{I}$) gripping the base plate from below, and the base plate (4) being provided with a lashing ($4^{II}$) oriented toward the pivot of the hinge arm (1) and arranged above a surface of the base plate (4) and, at the opposite end, the base plate being provided with a second crossbeam ($4^{I}$) arranged over a recess ($4^{V}$) in said base, the first crossbeam ($2^{I}$) being aligned below a free end ($4^{III}$) of the lashing ($4^{II}$) and the second crossbeam ($4^{I}$) engaging a free end of a latch ($3^{I}$) of the slider (3) received in said recess, whereby the latch is disengaged from the second crossbeam when the spring-loaded slider is pressed in said direction, wherein a pusher stud ($3^{II}$) of the slider (3) is arranged coaxially with the spring (7) and separated from the latch ($3^{I}$) by a slot ($3^{IV}$), and wherein the slot ($3^{IV}$) accommodates a third crossbeam ($2^{II}$) arranged at an end of the mounting element (2) opposite to the first crossbeam ($2^{I}$).

* * * * *